United States Patent [19]

Mattoon

[11] 4,099,562

[45] Jul. 11, 1978

[54] DEVICE FOR LIMITING LEAKAGE FROM WELL HEAD STUFFING BOX ASSEMBLY

[76] Inventor: Roland W. Mattoon, P.O. Box 1302, Drayton Valley, Alberta, Canada

[21] Appl. No.: 782,281

[22] Filed: Mar. 28, 1977

[30] Foreign Application Priority Data

Feb. 7, 1977 [CA] Canada ..... 271174

[51] Int. Cl.[2] ..... E21B 33/03

[52] U.S. Cl. ..... 166/84; 166/80

[58] Field of Search ..... 166/80, 84, 95, 97, 166/325; 137/527

[56] References Cited

U.S. PATENT DOCUMENTS

| | | | |
|---|---|---|---|
| 1,708,261 | 4/1929 | Crowell et al. | 166/80 |
| 3,468,374 | 9/1969 | Reeves | 166/84 |
| 3,939,910 | 2/1976 | Bruce | 166/84 |

*Primary Examiner*—James A. Leppink

*Attorney, Agent, or Firm*—Beveridge, DeGrandi, Kline & Lunsford

[57] ABSTRACT

A device for limiting leakage from a well head stuffing box assembly of the type which includes a vertically reciprocating polished rod. The device provides a chamber surrounding the rod, and a flap valve which is spring loaded to close against a valve seat which surrounds the aperture for the polished rod at the upper end of the chamber. The valve is normally held open by the rod but springs up to close the aperture if the rod breaks and leaves the chamber.

6 Claims, 2 Drawing Figures

DEVICE FOR LIMITING LEAKAGE FROM WELL HEAD STUFFING BOX ASSEMBLY

The present invention relates to a device for limiting leakage from a well head stuffing box assembly of the type including a vertically reciprocating polished rod which operates a pump within the well. This invention relates to an improvement in what is described in my Canadian Pat. No. 932,353 issued Aug. 21, 1973, and in the corresponding U.S. Pat. No. 3,815,925 issued June 11, 1974.

Oil and other well fluids are commonly pumped by means of a pump located down the well and operated by a vertically reciprocating string of sucker rods which terminate in an upper polished rod, moved by apparatus above the well head. At the well head there is a T-junction which provides an outlet for the fluid, and through the top of which passes the polished rod. Oil is prevented from escaping from the top of the junction by a stuffing box assembly.

My aforesaid prior patents provide a stuffing box assembly having two spaced stuffing boxes separated by a chamber, the chamber being connected to a pressure gauge to monitor escape of fluid up through the lower stuffing box. A special feature of the invention described in my prior patents is a flexible connection between the two stuffing boxes which allows for misalignment between the assembly and the polished rod. Another feature of my prior patents is the provision of a ball intended to be lifted against a valve seat by fluid pressure and thus to seal the bore through which the polished rod passes in the event of this rod breaking and leaving the assembly.

I have found that the ball valve described in my prior patents does not operate reliably in wells having a very low well head pressure, since the fluid pressure is not sufficient to lift the ball onto the valve seat. The present invention provides an improved device which overcomes this drawback.

In accordance with the present invention, a device is provided for limiting leakage from a well head stuffing box assembly, in which the assembly has means defining a chamber surrounding the polished rod, and in which the upper end of the chamber is defined by a downwardly facing annular valve seat, the device including a flap valve member mounted within the chamber on a pivot adjacent to the valve seat, with the flap valve member being biased by spring means towards a closed position in which it seals against the valve seat. The flap valve member is held open in normal operation by the polished rod which slides against this member, but in the event of the rod leaving the chamber the flap valve member is immediately moved to the closed position by the spring, irrespective of the pressure in the fluid.

The chamber may be provided by parts which concentrically surround the rod, with the pivot for the valve member being carried by a ring mounted adjacent the valve seat. The whole valve arrangement can be included within a cylindrical body part, providing an assembly which is less bulky than the arrangement which is illustrated in FIG. 2 of my prior patents.

Figure 1:
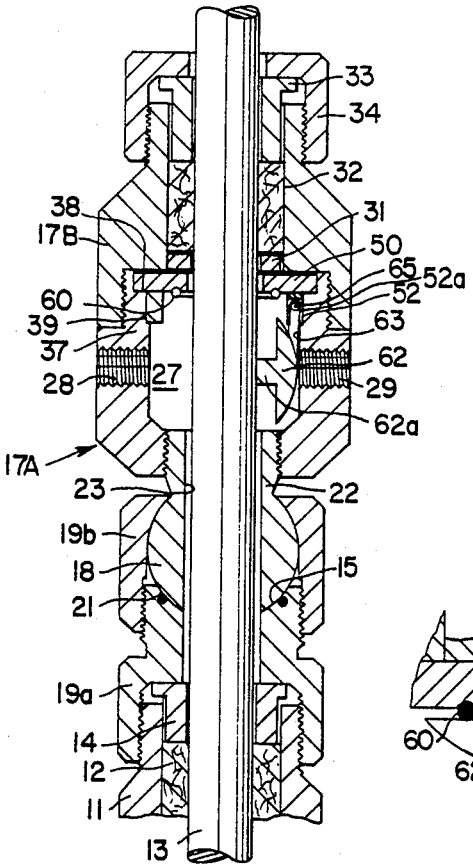
Figure 2:
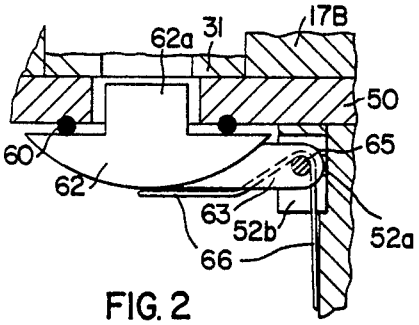

The invention will now be described by way of example with reference to the accompanying drawings, in which FIG. 1 shows a longitudinal sectional view of a stuffing box assembly including the valve device of the present invention, and FIG. 2 shows a detail view of the flap vlave in closed position.

The assembly shown in the drawing forms part of a sucker rod pumping unit at the top of an oil well. The assembly includes a lower stuffing box formed by a tube 11 at the upper end of the oil well containing a packing 12 through which a vertically reciprocal polished pump rod 13 passes. A packing gland 14 surrounding the pump rod 13 fits within the upper end of the tube 11 and engages the upper end of the packing, being retained in place by a nut member **19*a* screwed onto an external screw thread on the tube 11. The upper end of the nut member 19*a* is provided with a concave surface 15, in which is seated the ball-shaped lower end portion 18 of a lower body part 17A. The ball-shaped end portion 18 is retained in position by a nut 19*b* which has an internal screw thread engaging with an external screw thread of the nut member 19*a*, and which has a curved inner surface engaging the ball-shaped portion 18 to retain it on the concave surface 15. A sealing ring 21 is provided on the concave surface 15 and engaging the end portion 18**.

The tubular lower body part 17A includes an intermediate connecting portion 2 extending upwardly from the ball-shaped end portion 18 above the nut **19*b*. The intermediate connecting portion 22 and the ball-shaped end portion 18 have a bore 23 for the rod 13. The intermediate connecting portion 22 has an external screw thead mating with an internal screw thread on the main portion of lower body part 17A**.

The upper portion of the lower body part 17A is of cylindrical form and defines a cylindrical chamber 27, the sides of which contain opposed passages 28 and 29 which extend from the chamber to the exterior of the assembly and which are screw threaded. The passage 28 is intended to connect the chamber 27 to a pressure switch, and the passage 29 is intended to connect the chamber to a pressure gauge these devices being used, in accordance with known practice, for monitoring the leakage of fluid through the lower stuffing box. The lower body part also has an outwardly threaded projection 37 of reduced diameter, the interior of this projection 37 having upwardly facing upper and lower shoulders 38 and 39 respectively.

An upper body part 17B has an axial bore spaced from the rod 13, and has a threaded counter bore in its lower end engaging with the threads of the extension 37 of the lower body part. The base of the counter bore portion of the upper body part provides a downwardly facing shoulder, and when the two body parts are engaged as shown an annular member 50, of flat form, and a ring member 52 of cylindrical form, are trapped respectively between this downwardly facing shoulder and the upper shoulder 38 of the respective body parts, and between the annular member 50 and the lower shoulder 39.

The axial bore in the upper body part 17B accommodates a collar 31 resting on top of the annular member 50, and a packing 32 resting on this collar and held in place by a gland 33. Gland 33 is in turn held in place by a nut 34 engaging an external thread on a reduced upper portion of the upper body part. This assembly provides an upper stuffing box.

The assembly as so far described, including the upper and lower stuffing boxes, provides normally effective sealing means for preventing leakage of fluid up through the assembly, and at the same time misalignment between the upper stuffing box and the polished rod can be accommodated by movement of the ball-shaped portion 18 against the surface 15 at the top of the lower stuffing box. A valve will now be described which prevents upwards flow of fluid in the event that breakage causes the polished rod 13 to leave the chamber 17.

The annular member 50 has in its lower surface a recess accommodating a sealing ring 60. This provides a downwardly facing valve seat which, in the absence of rod 13, can receive a pivoted flap valve member 62. The valve member is mounted on an arm 63, movable about a pivot adjacent the valve seat and provided by a short pin 65 the ends of which rest in the bottom of an outwardly facing slot **52*a* in the ring member 52, being held in place by the surrounding inner surface of projection 37. The arm 63 is movable within an axial slot 52*b* in the ring member 52, and a valve spring 66, which comprises a spring wire having coils surrounding pin 65, bears on valve 62 and on the wall of chamber 27 in such manner as to urge the arm and valve member 62 upwardly, to bring member 62 into concentric sealing engagement with sealing ring 60 (as shown in FIG. 2) when the rod 13** vacates the chamber.

Normally, however, the valve member 62 is held open by the rod 13 engaging the extruded centre **62*a* of the valve member to counteract the soft spring force of the valve spring. This arrangement positively prevents upwards flow of fluid through the upper stuffing box, even with low fluid pressure, in the event of rod 13** breaking and leaving the chamber, the valve member, upon sealing, being firmly held in place by fluid pressure.

I claim:

1. A device for limiting leakage from a well head stuffing box assembly of the type including a vertically reciprocating polished rod, said device including means defining a chamber concentrically surrounding the rod, the upper end of the chamber being defined by a downwardly facing annular valve seat, said device including a flap valve member mounted within said chamber on a pivot carried by a ring member adjacent to said valve seat, said flap valve member being biased by spring means towards a closed position in which it seals against the valve seat, and being arranged normally to be held open by said rod.

2. A device for limiting leakage from a well head stuffing box assembly of the type including a vertically reciprocating polished rod, said device including:

an upper body part with an axial bore normally surrounding said rod, said part having a threaded counter bore in its lower end communicating with said axial bore, and having a downwardly facing shoulder separating the axial bore from the counter bore, a lower body part having a recess in its upper end which provides a chamber surrounding the rod, and having a threaded projection engaging with said threaded counter bore, said projection having internal, upwardly facing upper and lower shoulders, an annular member providing a downwardly facing annular valve seat trapped between said downwardly facing shoulder of the upper body part and the upper shoulder of the lower body part, said valve seat defining the upper end of said chamber and a ring member carrying a pivot adjacent to said valve seat said ring member being trapped between said annular member and the lower shoulder of the lower body part;

said device including a flap valve member mounted within said chamber on said pivot, said flap valve member being biased by spring means towards a closed position in which it seals against the valve seat, and being arranged normally to be held open by said rod.

3. A device according to claim 2, wherein said pivot rests in the bottom of an outwardly facing transverse slot in said ring member, said flap valve member being connected to said pivot by an arm movable within an axialy extending slot in said ring member and communicating with said transverse slot.

4. A device according to claim 2, wherein said upper body part contains an upper stuffing box, and wherein said lower body part is attached to a lower stuffing box.

5. A stuffing box assembly for limiting leakage from well head of the kind including a reciprocating polished rod, the assembly having tubular means surrounding the rod and including a pair of stuffing boxes surrounding the rod and longitudinally spaced along the rod, the tubular means being formed in two longitudinal portions having mutually engaging curved surfaces providing a pivotal connection therebetween, each portion including a respective one of said stuffing boxes, and one of said portions forming a chamber surrounding the rod to receive fluid leaking through one of the stuffing boxes, said one portion having a passage communicating the chamber with the exterior of said one portion, and in which the upper end of said chamber is defined by a downwardly facing annular valve seat, said assembly further including a flap valve member mounted within said chamber on a pivot adjacent to said valve seat, said flap valve member being biased by spring means towards a closed position in which it seals against the valve seat, and being arranged normally to be held open by said rod.

6. A stuffing box assembly according to claim 5, wherein said one portion includes a cylindrical body part concentrically surrounding the polished rod and entirely surrounding the chamber and valve member.

* * * * *